United States Patent [19]

Youngeberg

[11] Patent Number: 5,075,047

[45] Date of Patent: Dec. 24, 1991

[54] SPRAY PAD HUMIDIFIER

[75] Inventor: Judy L. Youngeberg, Manheim, Pa.

[73] Assignee: Herrmidifier Company, Inc., Lancaster, Pa.

[21] Appl. No.: 542,927

[22] Filed: Jun. 25, 1990

[51] Int. Cl.[5] ..... B01F 3/04

[52] U.S. Cl. ..... 261/100; 126/113; 261/105; 261/DIG. 15; 261/DIG. 41

[58] Field of Search ..... 261/100, 101, 105, DIG. 15, 261/DIG. 41; 126/113

[56] References Cited

U.S. PATENT DOCUMENTS

| | | | |
|---|---|---|---|
| 1,699,899 | 10/1929 | Little | 261/DIG. 41 |
| 3,034,772 | 5/1962 | Schulz | 261/DIG. 41 |
| 3,450,124 | 6/1969 | Mauller, Jr. | 126/113 |
| 3,512,763 | 5/1970 | Winton | 126/113 X |
| 3,689,037 | 9/1972 | Payne | 126/113 X |
| 3,739,767 | 6/1973 | Peters | 126/113 |
| 3,791,633 | 2/1974 | Lowe | 126/113 X |
| 3,799,513 | 3/1974 | Winton | 126/113 X |
| 3,855,371 | 12/1974 | Morrow et al. | 261/100 |
| 4,354,985 | 10/1982 | Johnson | 261/100 |
| 4,490,311 | 12/1984 | Shepherd | 261/DIG. 15 |

*Primary Examiner*—Richard L. Chiesa

*Attorney, Agent, or Firm*—Brady, O'Boyle & Gates

[57] ABSTRACT

A spray pad humidifier including a housing having two side wall portions extending perpendicular to each other along one edge, and being interconnected along the opposite edge by an arcuate wall. One of the side wall portions is provided with an opening communicating with the return cool air plenum of a furnace, and the other side wall portion is provided with an opening communicating with the hot air supply plenum of the furnace. A one-piece evaporator pad is configured to extend over both openings, and a water spray nozzle is mounted on the housing for spraying water into the housing and onto the portion of the pad extending over one of the openings. Reinforcing ribs are formed on the housing to not only provide channels within the housing for holding the evaporator pad in the operative position, but also to provide troughs for collecting drain water within the housing.

18 Claims, 3 Drawing Sheets

1
6
7
8
9
10
11
11'
12
13
14
15
16
17
18
20
21
22
23
24
25
26
27
28
29
30

SPRAY PAD HUMIDIFIER

BACKGROUND OF THE INVENTION

Humidifier assemblies of the type wherein water is sprayed onto an evaporator pad through which air to be humidified is forced, are disclosed in U.S. Pat. Nos. 3,791,633, dated Feb. 12, 1974; and 4,354,985, dated Oct. 19, 1982. While the humidifiers disclosed in these patents are satisfactory for their intended purpose, due to their construction and arrangement, the evaporative area of the evaporator pad is somewhat restricted, thereby reducing the evaporative capacity of the humidifier, and the structural components required for supporting the evaporator pads increases the expense of manufacturing the units.

SUMMARY OF THE INVENTION

To overcome the disadvantages experienced in the prior art spray pad humidifiers, the humidifier of the present invention has been devised, which comprises, essentially, a molded plastic housing having two side wall portions extending perpendicular to each other along one edge, and being interconnected along the opposite edge by an arcuate wall which extends substantially through an arc of 90°. One of the side wall portions is provided with a rectangular opening adapted to communicate with the return cool air plenum of a furnace, and the other side wall portion is provided with a circular opening communicating with the hot air supply plenum of the furnace. An evaporator pad of foamed, open pore, polyurethane is positioned in the housing and is dimensioned to extend over both the rectangular opening and circular opening, to thereby increase the evaporative area of the pad and, thus, the evaporative capacity of the unit. The housing walls are provided with ribs formed outwardly therefrom, which not only provide a reenforcement for the housing but also provide a water drain trough interiorly of the housing as well as a channel or socketing retainer for holding the evaporative pad in the operative position within the housing. A circular opening is provided in the arcuate wall aligned with the circular opening in the side wall, and a solenoid actuated water spray nozzle is mounted in the arcuate wall circular opening, on an easily removable cap that closes this opening, for spraying water into the housing and onto the portion of the evaporator pad covering the side wall circular opening. By this construction and arrangement, supply hot air from the furnace plenum flows through the side wall circular opening and the portion of the pad covering the opening. This air carries some of the water mist with it and onto the portion of the pad covering the rectangular opening, thereby wetting this portion of the pad; thus, air passing through both portions of the pad evaporates water therefrom, picks up the water vapor in the housing, and carries the water vapor into the return cool air plenum of the furnace, to thereby accomplish the desired humidification.

DESCRIPTION OF THE PREFERRED EMBODIMENT

Figure 1:
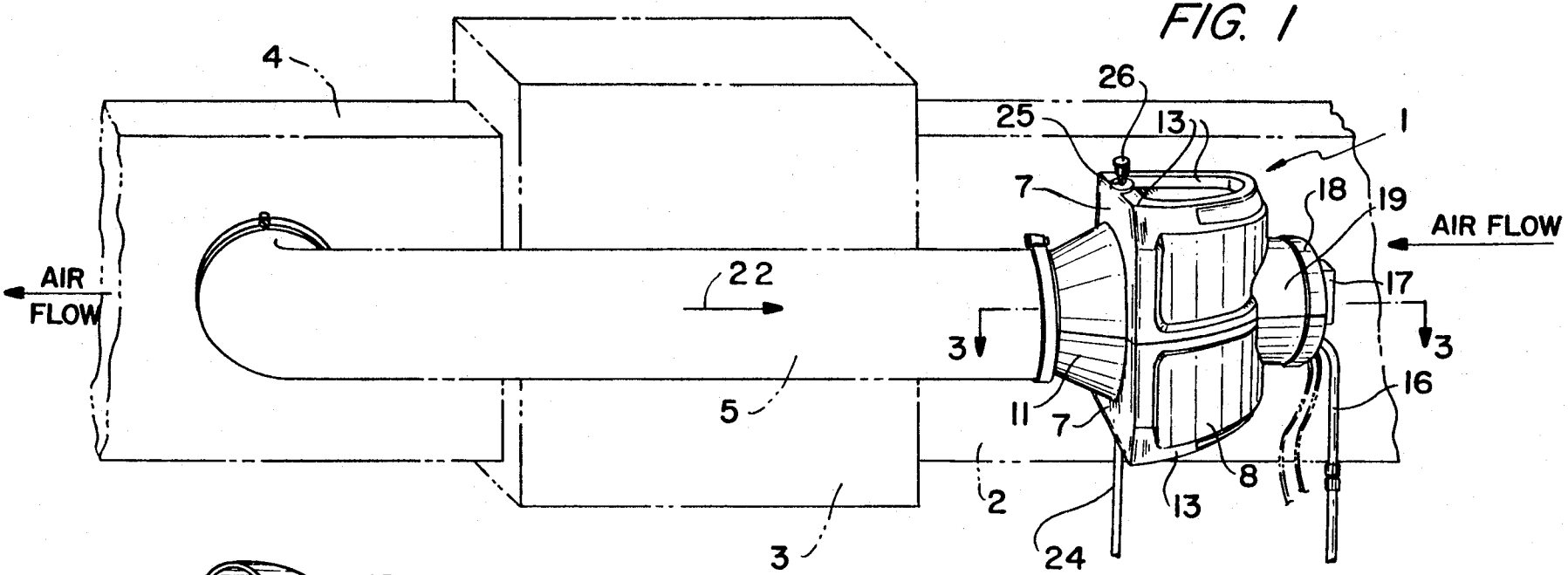
FIG. 1 is a perspective view of the spray pad humidifier of the present invention mounted in operative position on a furnace duct system.
Figure 2:
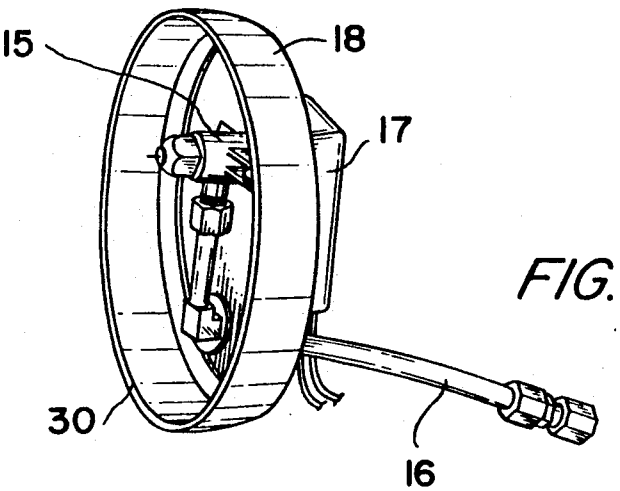
FIG. 2 is a perspective view of the solenoid actuated water spray nozzle and associated mounting cap employed in the humidifier of the present invention.

Referring to the drawings in greater detail, and more particularly to FIG. 1, the humidifier 1 of the present invention is adapted to be mounted on and be in communication with a return cool air plenum 2 of a furnace 3. The humidifier 1 also communicates with a hot air supply plenum 4 of the furnace through a duct 5.

Figure 3:
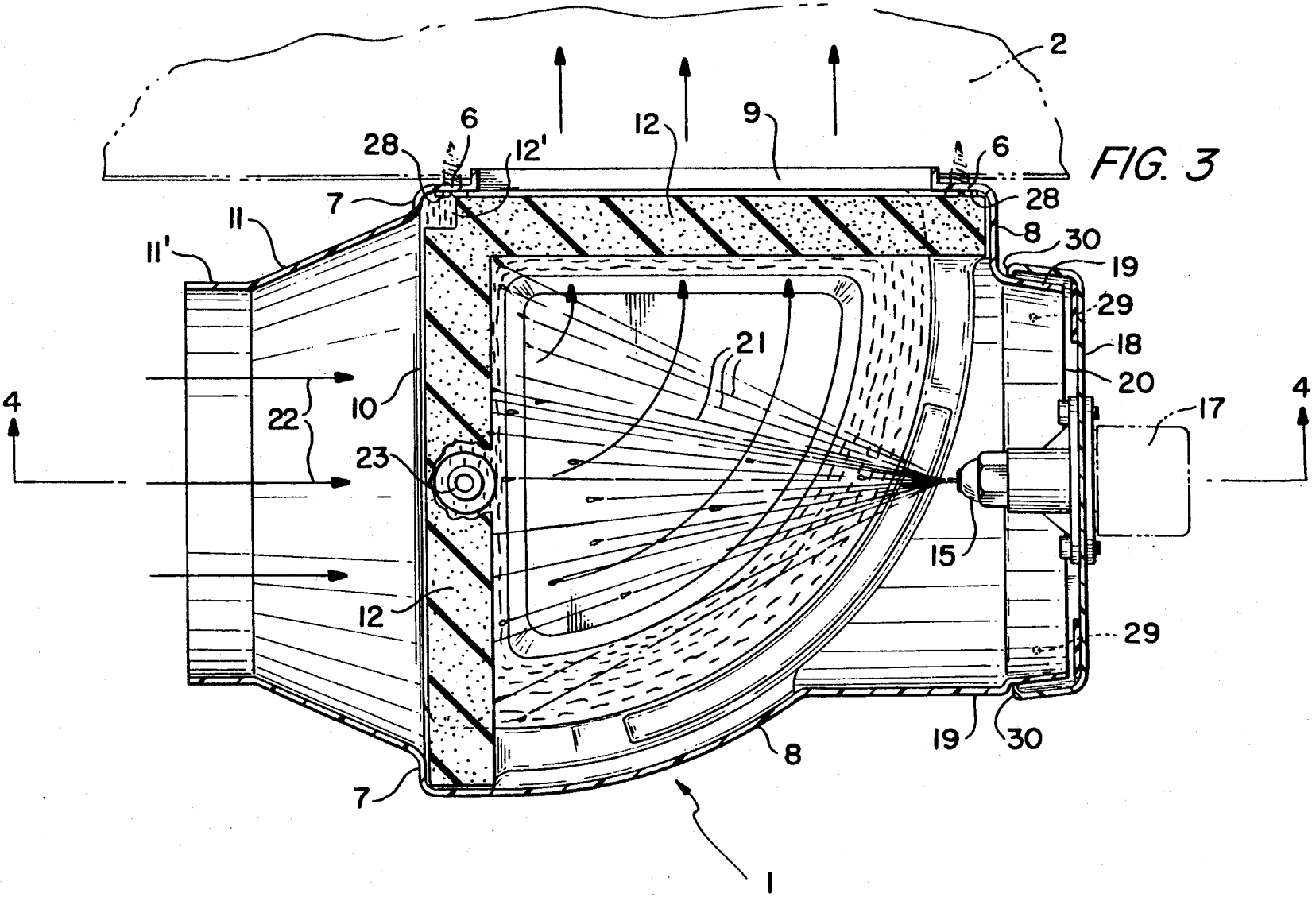
FIG. 3 is a horizontal sectional view taken along line 3—3 of FIG. 1.
Figure 4:
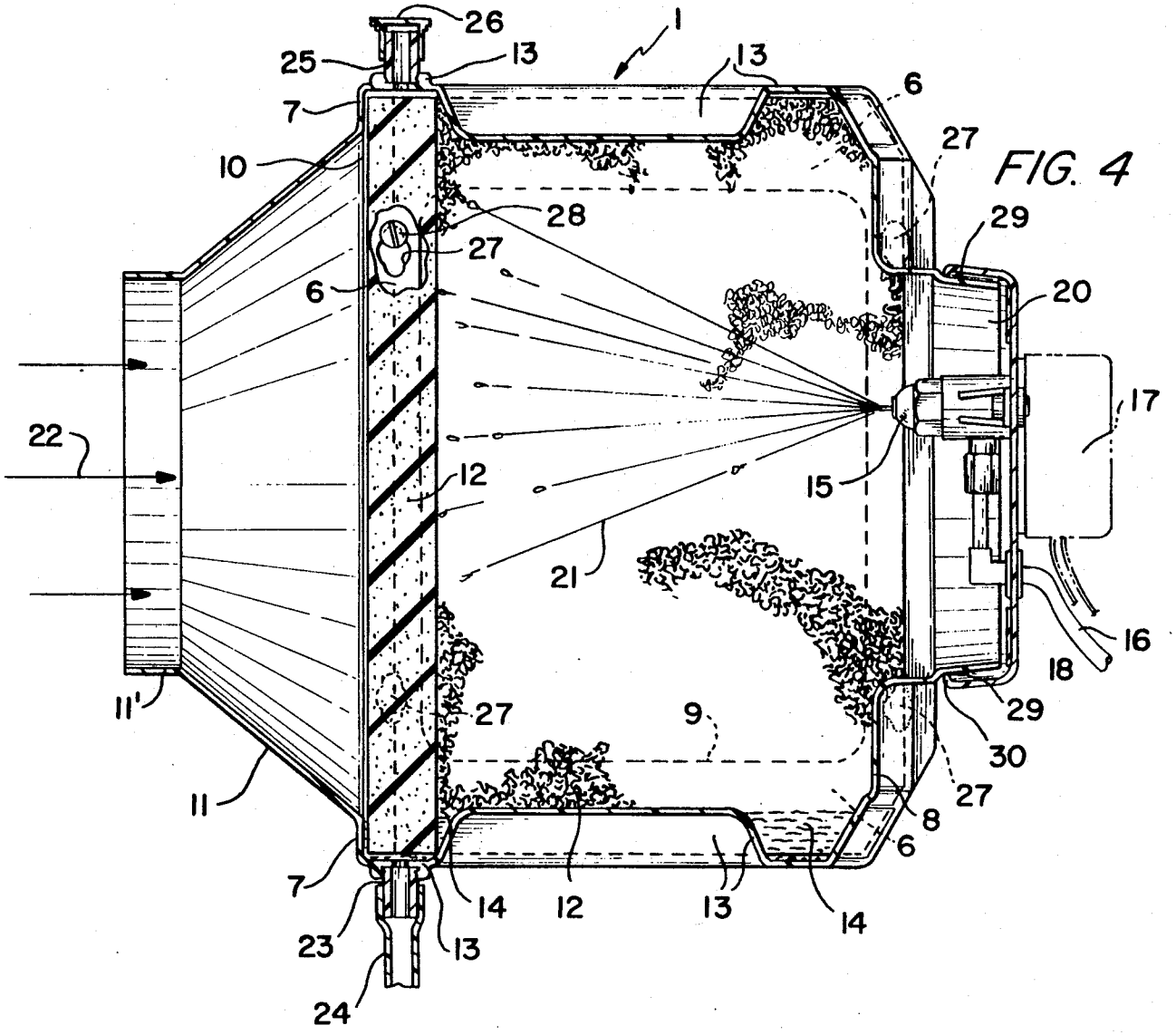
FIG. 4 is a vertical view taken along line 4—4 of FIG. 3.

The details of the construction of the humidifier 1 are illustrated in FIGS. 3 and 4, wherein it will be seen that the humidifier comprises a molded one-piece plastic housing having two vertically disposed side wall portions 6 and 7 extending perpendicular to each other along one edge and being interconnected by a vertically disposed arcuate wall 8 which extends substantially through an arc of 90°. Sidewall portion 6 is provided with a rectangular opening 9 communicating with the cool air plenum 2, and sidewall portion 7 is provided with a substantially circular opening 10 communicating with an integral outwardly converging conical throat portion 11, that terminates in a substantially circular open connecting collar 11', adapted to be connected to the end of the hot air supply duct 5 remote from its connection to hot air supply plenum 4.

Each of the openings 9 and 10 have an evaporator pad 12 of foamed, open pore, polyurethane, or the like, extending thereover, the pad being of one-piece construction having a transverse cut 12' partially through the thickness of the pad, allowing it to be bent to provide two portions extending perpendicular to each other so as to extend over the openings 9 and 10, as shown in FIG. 3. By extending the evaporator pad 12 over both openings 9 and 10 the evaporative area for air passing through the humidifier is greatly increased, thus providing a more efficient and more economically operating humidifier by substantially increasing the gallons of water evaporated into the air relative to the gallons of water supplied to the humidifier through the spray nozzle, to be discussed later herein, and thus reducing the amount of water exiting the humidifier through the drain.

In order to hold the evaporator pad 12 in the operative position within the housing, the housing is provided around the perimeter of its top and bottom walls with integrally formed, outwardly extending ribs 13 forming channels, which adjoin the side wall portions 6 and 7 and arcuate wall 8, to thereby provide a socketing retainer for the top and bottom edge portions of the evaporator pad 12. The ribs 13 not only retain the pad 12 in the operative position within the housing covering the openings 9 and 10, but also reinforce the molded housing walls to rigidify the one-piece housing, as well as provide a water drain trough 14 interiorly of the housing, to be described more fully hereinafter.

In order to provide the humidifier housing and evaporative pad 12 with a water mist, a solenoid actuated spray nozzle 15, having a water inlet line 16, and an electrical control box 17 including a solenoid for opening and closing the nozzle 15, is mounted on a closure cap 18 adapted to be removably mounted on the wall portion 19 of the arcuate wall 8 having a circular opening 20 aligned with the circular opening 10 on the side wall 7. Wall portion 19 on the outer side thereof carries a plurality of small protrusions 29 engaged by the peripheral edge 30 of closure cap 18 by snap-type action, whereby the closure cap 18 is readily disconnected and connected from and to the molded humidifier housing. Since the water inlet line 16 and the electrical supply lines are respectively connected to the spray nozzle 15 and electrical control box 17 mounted on closure cap 18, by simple snap-action removal of the closure cap, the water and electrical supply lines are disconnected from the humidifier housing, so the humidifier housing can thereafter be easily removed from the plenum for maintenance, cleaning, or replacement of the evaporator pad 12.

By the construction and arrangement of the spray pad humidifier of the present invention, thus far described, water 21 from the spray nozzle 15 is directed into the humidifier housing and against the portion of the pad 12 carrying the side wall circular opening 10, to wet that pad, as shown in FIG. 3 and 4. Supply hot air 22 from the furnace plenum 4 flows through the side wall circular opening 10, the portion of the pad 12 covering the opening 10, and is directed by the arcuate side wall 8 of the housing through the portion of the pad covering the rectangular opening 9 in the side wall 6 and into the return cool air plenum 2 of the furnace. The supply hot air 22 carries some of the water mist 21 with it and onto the portion of the pad 12 covering the rectangular opening 9, thereby wetting this portion of the pad; thus, air 22 passing through both portions of the wetted pad 12 evaporates water therefrom, picks up water vapor in the housing, and carries the water vapor into the return cool air plenum 2 of the furnace. The arcuate side wall 8 in addition to directing air flow in the right direction, removes areas within the housing that would cause swirling of the air and condensation of spray on the inner sides of the housing to water droplets that would run down the inner sides and reduce the efficiency of the unit.

To complete the structure of the humidifier, a nipple 23, FIG. 4, is connected to the bottom of rib portion 13 adjacent the lower end portion of side wall 6 and is connected to a suitable drain line 24, whereby the water sprayed onto and entrained on the evaporator pad 12 trickles down the pad into the water drain trough 14 formed by the ribs 13, and then drains outwardly from the humidifier housing through nipple 23 and drain line 24. When the unit is operating there will be a slow, steady stream of water from the drain line 24. This washes away minerals from the pad 12 and drain trough 14. Another nipple 25 having a removable closure cap 26 is mounted on the rib portion 13 adjacent the upper end portion of the side wall 6, whereby the humidifier 1 is constructed so that it is reversible by 180°, so it can be mounted on either side of the cool air plenum 2. Thus, when the humidifier 1 is mounted on the side wall of the cool air plenum 2, as shown in FIG. 1, the nipple 23 is at the bottom and is connected to the drain line 24, but if the construction and arrangement of the furnace ductwork requires the humidifier 1 to be mounted on the wall of the cool air plenum 2 opposite from that of FIG. 1, then the humidifier 1 would be positioned upside down from the position shown in FIG. 1, so that the nipple 25 will be at the bottom and will be connected to the drain line 24, and the nipple 23, then at the top, will be closed by the cap 26.

In order to facilitate mounting the humidifier on either side of plenum 2, a plurality of key-hole slots 27 are provided in the side wall portion 6 adjacent the rectangular opening 9, and adapted to receive the heads of screws 28 secured to and protruding from the plenum side wall.

If physical constraints of the positioning of the furnace and plenum system do not allow the humidifier 1 to be mounted on the cool air plenum, with its opening 9 in communication with a corresponding opening in the return or cool air plenum 2, the humidifier housing may instead be mounted on the supply or hot air plenum 4, with its rectangular opening 9 in communication with a corresponding opening in the hot air plenum 4. In this arrangement the duct 5 is connected to an opening in the cool air plenum 2. Since air flows from the high pressure hot air plenum to the low pressure cool air plenum, its path would then be from the hot air plenum 4 through the rectangular opening 9 in the side wall 6, through the portion of the pad covering the rectangular opening 9 into the housing, thereafter directed by the arcuate side wall 8 of the housing through the housing and portion of the pad covering side wall circular opening 10, through the circular opening 10 out of the humidifier through duct 5, and into the cool air plenum 2. This air flow results in air flow parallel to the water spray direction, rather than counter to the water spray direction as in the preferred mounting of the humidifier, and the air flow does not carry water to the portion of pad 12 covering rectangular opening 9. Therefore, the portion of pad 12 covering rectangular opening 9 remains substantially dry, and the evaporative capacity of the unit is thus reduced by this mode of mounting.

From the above description it will be appreciated by those skilled in the art that the construction and arrangement of the spray pad humidifier of the present invention results in a humidifier having an increased evaporative capacity due to the increased evaporative area provided by the pad 12; while at the same time decreasing the expense of manufacturing the unit by molding the housing with the integral ribs 13 which not only reinforce the humidifier housing but also provide a retainer for holding the pad 12 against the openings 9 and 10, as well as a water drain trough 14.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A spray pad humidifier comprising, a housing including a pair of side walls, an opening provided on one side wall positioned to communicate with a return cool air plenum of a furnace, an opening in the other side wall located to communicate with a hot air supply plenum of a furnace, an evaporator pad mounted in said housing, said pad having respective portions extending over each of the openings in the side walls of said housing, to thereby increase the evaporative area of the pad, spray means mounted on said housing for spraying water into said housing and against the portion of the pad extending over the side wall opening communicating with the hot air supply plenum, whereby air passing from the hot air supply plenum to the return cool air plenum flows through both portions of the pad and evaporates water therefrom, to thereby obtain the desired humidification in the furnace plenum.

2. A spray pad humidifier according to claim 1, wherein the pair of side walls extend perpendicular to each other along one edge, and an arcuate wall interconnecting the opposite edges of said side walls, whereby the air from the hot air supply plenum is directed into the return cool air plenum of the furnace.

3. A spray pad humidifier according to claim 2, wherein the pad is of one-piece construction of open pore material, said pad being bent to the respective portions extending perpendicular to each other.

4. A spray pad humidifier according to claim 3, wherein the housing is formed of molded plastic having integral, outwardly extending reinforcing ribs, said ribs forming channels in said housing, portions of said pad being inserted into said channels, whereby the pad is held in operative position within said housing.

5. A spray pad humidifier according to claim 4, wherein the channels provide a trough for collecting drain water within the housing.

6. A spray pad humidifier according to claim 5, wherein a drain line is connected to the trough for draining the water out of the housing.

7. A spray pad humidifier according to claim 5, wherein a drain nipple is connected to a channel adjacent the lower end portion of one of the side walls, and another drain nipple is connected to a channel adjacent the upper end portion of said one side wall, whereby the housing can be positioned on either side of the furnace return cool air plenum, and a respective drain nipple can be connected to a drain line.

8. A spray pad humidifier according to claim 1, wherein the spray means comprises, a cap removably mounted on said housing, a solenoid actuated spray nozzle mounted on said cap and extending internally of said housing.

9. A spray pad humidifier comprising, a molded plastic housing having two side wall portions extending perpendicular to each other along one edge, an arcuate wall extending substantially through an arc of 90° interconnecting the opposite edges of said side walls, a rectangular opening provided in one of the side walls positioned to communicate with the return cool air plenum of a furnace, a circular opening provided in the other side wall located to communicate with the hot air supply plenum of the furnace, a one-piece evaporative pad positioned within said housing and bent to provide respective portions extending over the circular and rectangular openings, and spray means mounted on said housing for spraying water into said housing and onto the portion of the pad extending over the circular opening, whereby air passing from the hot air supply plenum is directed to the return cool air plenum by the arcuate wall, and while flowing through both portions of the pad water is evaporated therefrom, to thereby obtain the desired humidification in the furnace plenum.

10. A spray pad humidifier according to claim 9, wherein the housing is formed with integral outwardly extending reinforcing ribs providing channels within said housing, portions of said pad being inserted into said channels, whereby the pad is held in operative position within the housing.

11. A spray pad humidifier comprising, a housing including a pair of side walls, an opening provided on one side wall positioned to communicate with a first air plenum of a furnace, an opening in the other side wall located to communicate with a second air plenum of a furnace, an evaporator pad mounted in said housing, said pad having respective portions extending over each of the openings in the side walls of said housing, to thereby increase the evaporative area of the pad, spray means mounted on said housing for spraying water into said housing and against the portion of the pad extending over the side wall opening communicating with the second air plenum, whereby air passing through said housing from the first or second plenum to the other flows through both portions of the pad and evaporates water therefrom.

12. A spray pad humidifier comprising, a molded plastic housing having two side wall portions extending perpendicular to each other along one edge, an arcuate wall extending substantially through an arc of 90° interconnecting the opposite edges of said side walls, a first opening provided in one of the side walls, a second opening provided in the other side wall, a one-piece evaporative pad positioned within said housing and bent to provide respective portions extending over the first and second openings, and spray means mounted on said housing for spraying water into said housing and onto the portion of the pad extending over the second opening, whereby air is directed inside said housing by the arcuate wall from one to the other of said openings, and while flowing through both portions of the pad water is evaporated therefrom.

13. A spray pad humidifier according to claim 12, wherein the housing is formed with integral outwardly extending reinforcing ribs providing channels within said housing, portions of said pad being inserted into said channels, whereby the pad is held in operative position within the housing.

14. A spray pad humidifier according to claim 12, in which said housing having top and bottom wall portions, outwardly extending reinforcing ribs on said top and bottom wall portions connected with and adjacent said two side wall portions, said ribs forming channels in said housing portions of said pad being inserted into said channels, whereby the pad portions are held in operative position within said housing.

15. A spray pad humidifier according to claim 14, in which said outwardly extending reinforcing ribs are around the perimeter of said top and bottom wall portions and are connected with and adjacent said two side wall portions and said arcuate wall.

16. A spray pad humidifier according to claim 14, in which said one-piece evaporative pad having said respective portions at right angles to each other.

17. A spray pad humidifier according to claim 14, in which said channels provide a trough for collecting drain water within the housing, and drain line means connected to said trough for draining the drain water out of the housing.

18. A spray pad humidifier according to claim 17, including separate drain line connecting means connected to said trough on said top wall and to said trough on said bottom wall, a cap closing said drain line connecting means connected to said trough on said top wall, said drain line means connected to said drain line connecting means connected to said trough on said bottom wall, whereby said humidifier housing is reversible by 180°.

* * * * *